US012504200B2

(12) United States Patent
Harter

(10) Patent No.: US 12,504,200 B2
(45) Date of Patent: Dec. 23, 2025

(54) FIN ARRANGEMENT OF A COOLING AIR OPENING

(71) Applicant: Dr. Ing. h.c. F. Porsche Aktiengesellschaft, Stuttgart (DE)

(72) Inventor: Sebastian Harter, Weissach (DE)

(73) Assignee: Dr. Ing. h.c. F. Porsche Aktiengesellschaft (DE)

( * ) Notice: Subject to any disclaimer, the term of this patent is extended or adjusted under 35 U.S.C. 154(b) by 438 days.

(21) Appl. No.: 18/084,672

(22) Filed: Dec. 20, 2022

(65) Prior Publication Data

US 2023/0250993 A1 Aug. 10, 2023

(30) Foreign Application Priority Data

Feb. 9, 2022 (DE) ..... 10 2022 102 973.5

(51) Int. Cl.
*F24F 13/14* (2006.01)

(52) U.S. Cl.
CPC ..... *F24F 13/1413* (2013.01)

(58) Field of Classification Search
CPC ..... F24F 13/1413; F24F 13/15; B60K 11/085
USPC ..... 454/358, 279, 268, 369, 335; 180/68.1
See application file for complete search history.

(56) References Cited

U.S. PATENT DOCUMENTS

| | | | | |
|---|---|---|---|---|
| 9,254,742 | B2 | 2/2016 | Chappex | |
| 2006/0060401 | A1* | 3/2006 | Bole | B62D 35/001 180/68.1 |
| 2017/0248066 | A1 | 8/2017 | Wolf et al. | |
| 2019/0023122 | A1* | 1/2019 | Herlem | B60K 11/085 |
| 2019/0056141 | A1* | 2/2019 | Carey | F24F 13/1486 |
| 2019/0084409 | A1 | 3/2019 | Komatsubara et al. | |
| 2020/0130500 | A1 | 4/2020 | Gil | |

FOREIGN PATENT DOCUMENTS

| | | | |
|---|---|---|---|
| DE | 102014114068 | A1 | 4/2015 |
| DE | 102020120614 | A1 | 2/2022 |

* cited by examiner

*Primary Examiner* — Vivek K Shirsat
(74) *Attorney, Agent, or Firm* — Buchanan Ingersoll & Rooney PC

(57) ABSTRACT

A fin arrangement of a cooling air opening includes a number of fins. The fins are adjustably arranged adjacently to the cooling air opening. The fins are arranged adjustably between a respective first end region of the adjustment and a respective second end region of the adjustment. A drive is directly coupled to a first fin of the fins for the purpose of directly driving the first fin. The first fin is coupled to at least one second fin of the fins by at least one coupling element for the purpose of indirectly driving the second fin. One stop element each is connected to the fins and abuts against a counter stop on at least one end region of the adjustment of the fins.

11 Claims, 6 Drawing Sheets

FIN ARRANGEMENT OF A COOLING AIR OPENING

CROSS-REFERENCE TO RELATED APPLICATION

Figure 1:
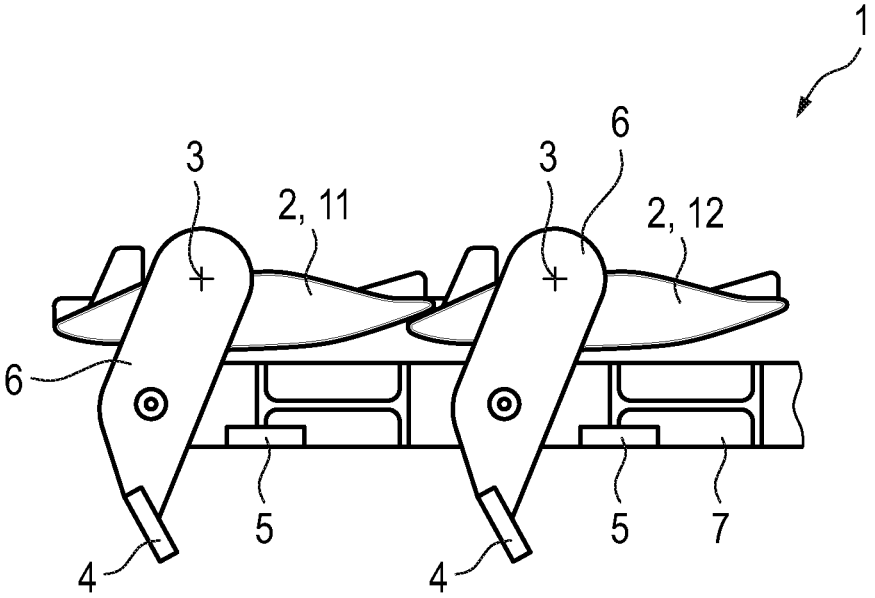

This application claims priority to German Patent Application No.: 10 2022 102 973.5, filed Feb. 9, 2022, the content of such application being incorporated by reference herein in its entirety.

FIELD OF THE INVENTION

The invention relates to a fin arrangement of a cooling air opening, in particular of a bow of a motor vehicle.

BACKGROUND OF THE INVENTION

In motor vehicles, the flow of air into a cooling air opening for the flow against a heat exchanger arranged downstream of the cooling air opening has been known for a very long time. Modern motor vehicles have fin arrangements comprising adjustable fins in order to control the air flow flowing through the cooling air opening, and the respective amount of air, with respect to the cooling air demand in order to keep the air resistance as low as possible, which has a favorable effect on the CO2 emission or the range. For example, the cooling air opening may be completely closed by the fins or may, on the other hand, be opened. A single drive is provided for actuating the fins, wherein this drive acts directly only on one fin and drives this one fin directly, while the plurality of fins are connected to one another by a coupling rod so that driving the one directly driven fin also indirectly drives the other fins. Fin arrangements having adjustable fins have become known through DE 10 2014 114 068 A1, which is incorporated herein by reference, for example.

In such fin arrangements, only one fin is directly driven by a drive, while the other fins are indirectly driven via a coupling rod starting from the driven fin. The fins typically do not have any end stops for their movement path so that at most the directly driven fin is also restricted in its movement path by means of the drive and the end stops thereof.

Depending on the external conditions, such as vehicle speed, fin size, degree of soiling of the bearings of the fins, etc., different forces act on the individual fins, for example due to the air flow, in washing systems, or also manual forces, for example in a hand wash, etc. This can then result in the position of individual fins or of all fins changing relative to one another, for example during a fast drive, which undesirably changes the flow through the cooling air opening. Force effects when the motor vehicle stands still can also interfere with the relative position of the fins relative to one another, which in turn also causes a disruptive effect on the subsequent air flow through the cooling air opening.

SUMMARY OF THE INVENTION

Described herein is a fin arrangement of a cooling air opening, in which the unintended adjustment of fins, even due to an external force effect, is reduced or avoided.

An exemplary embodiment of the invention relates to a fin arrangement of a cooling air opening comprising a number of fins, wherein the fins are adjustably arranged adjacently to the cooling air opening, wherein the fins are arranged adjustably between a respective first end region of the adjustment and a respective second end region of the adjustment, wherein a drive is provided, which is directly coupled to a first fin of the fins for the purpose of directly driving the first fin, and wherein the first fin is coupled to at least one second fin of the fins or to a plurality of second fins of the fins by means of at least one coupling element for the purpose of indirectly driving the second fins or the second fins, and/or one indirectly driven second fin is coupled to at least one further indirectly driven second fin by means of a coupling element for the purpose of indirectly driving the further indirectly driven second fin, wherein one stop element each is connected to the fins, which stop element abuts against a counter stop on at least one end region of the adjustment of the fins. The position of the fins in at least one end position is thereby defined so that additional external forces do not cause any change in the position of the fins and change the flow through the cooling air opening. This is in particular relevant in the end position opening the cooling air opening since maximum flow-through is desired there and an unwanted change in the position of the fins reduces the flow through the cooling air opening, which causes unwanted reduced cooling.

In an exemplary embodiment, it is also expedient if a coupling rod is provided as a coupling element for coupling all fins, or that a coupling rod is provided as a respective coupling element for coupling two or more adjacent fins in each case. A suitable coupling of the fins and their adjustment is thereby achieved. The adjustment of the individual fins may also be adjusted individually accordingly so that, for example, the curve of the turning angle can be adjusted appropriately.

It is also expedient if at least one fin comprises or all fins comprise a fin support, which is used to mount the fin and/or to couple the fin to the coupling element. The fin support is an element which is connected to or integrally formed with the fins and is used to mount the fin and adjust it. Accordingly, this fin support may also be used to couple the fin to the coupling element, for example in the form of a lever hinged to the coupling element.

It is also advantageous for the stop element to be formed on the fin support in at least one of the fins or in all fins. As a result, the stop element may be arranged far enough away from the axis of rotation of the fin to cause a large lever arm between the bearing of the fin and the stop element. As a result, greater forces can also be supported.

In a further exemplary embodiment, it is also advantageous for the stop element to be formed on the fin or on an additional element of the fin in at least one of the fins or in all fins. This can individually create an alternative if the installation space permits or requires it.

It is also expedient if at least one counter stop or the respective counter stop is formed on the coupling element or on the coupling elements. As a result, the stop of the fin within the kinematics can thus be achieved without using the bow of the motor vehicle having the cooling air opening as the stop.

It is also particularly advantageous if, when providing a coupling rod for a plurality of fins, the counter stops are provided on the one coupling rod or that, when providing a plurality of coupling rods for a plurality of fins, the counter stops are provided on the coupling rods. As a result, the coupling rod is used for a plurality of fins, which makes the coupling rod in its stable design a suitable element for the stop.

It is also expedient if at least one counter stop or the respective counter stop is formed on an additional element or on a respective additional element, which is formed adjacently to the cooling air opening in a bow part of the motor vehicle. This can individually create an alternative if the installation space permits or requires it.

Furthermore, it is expedient if at least a first counter stop and a second counter stop are provided on at least one coupling rod, wherein the first counter stop is arranged on an opposite side of the coupling rod with respect to the second counter stop. The force effect of the stops against the counter stops is thus substantially opposite, which fixes the coupling rod in position.

An exemplary embodiment of the invention relates to a motor vehicle having at least one cooling air opening and comprising a fin arrangement, in particular having two cooling air openings and comprising two fin arrangements, according to aspects of the invention.

BRIEF DESCRIPTION OF THE DRAWING FIGURES

Figure 2:
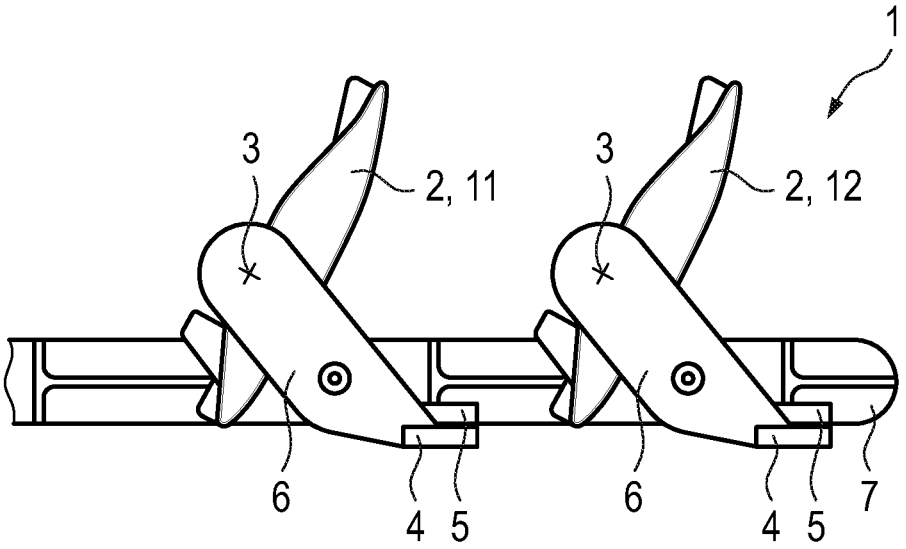
Figure 3:
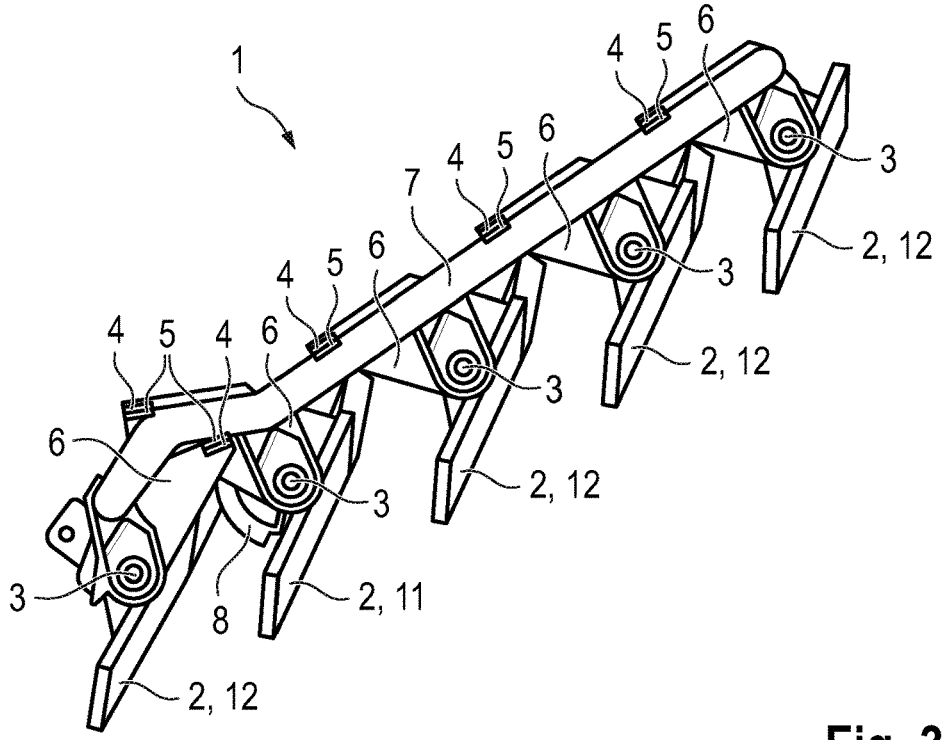
Figure 4:
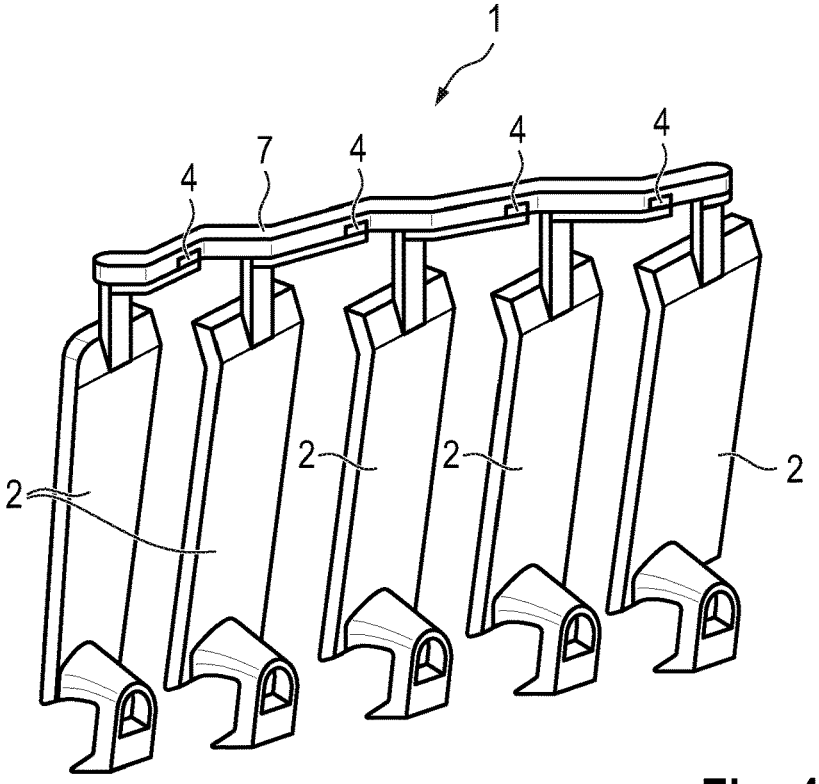
Figure 5:
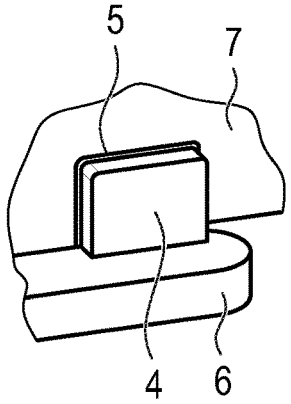
Figure 6:
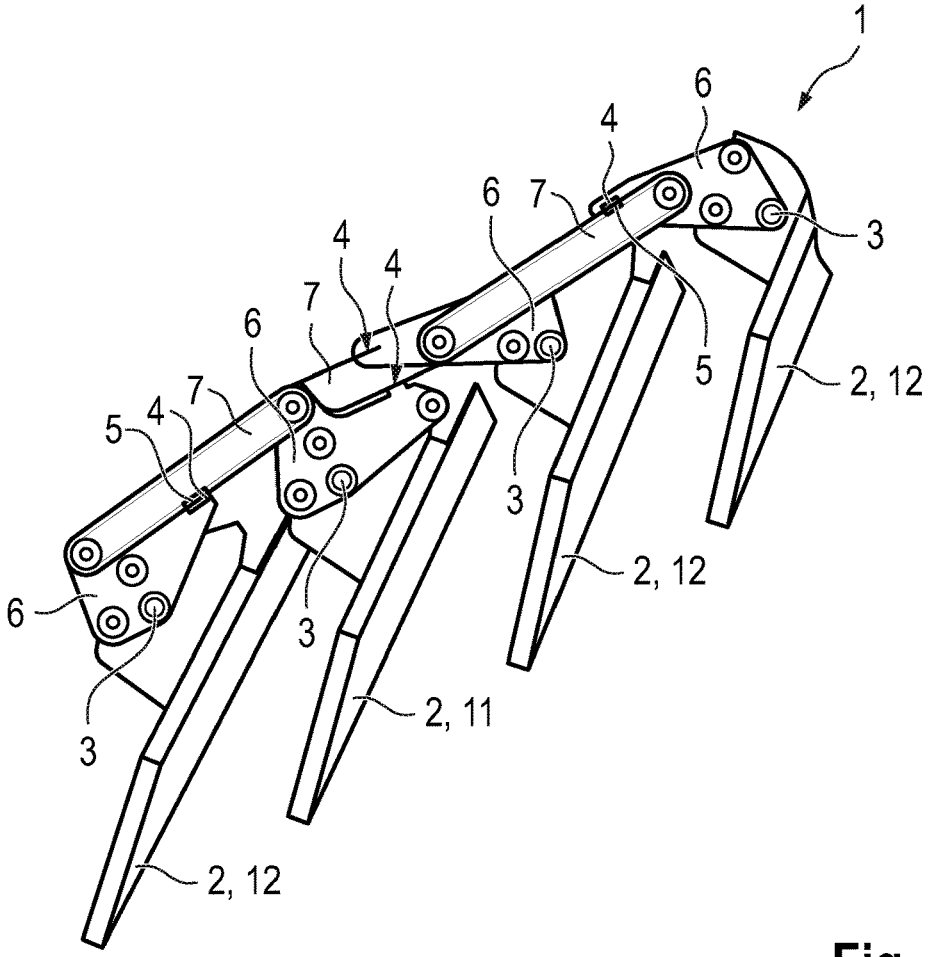
Figure 7:
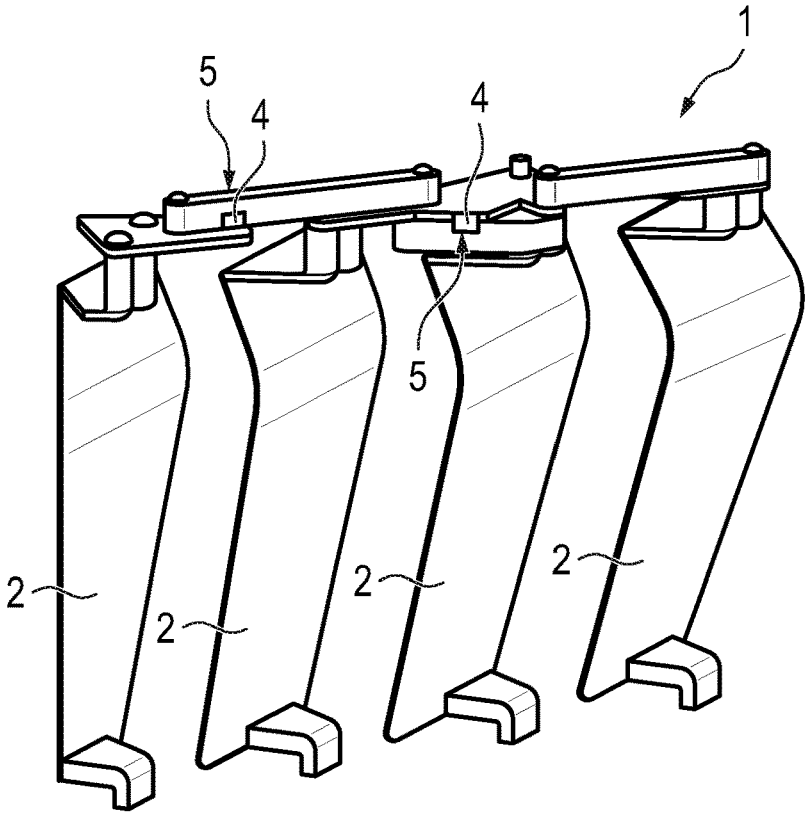
Figure 8:
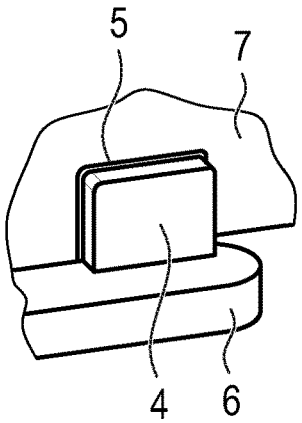
Figure 9:
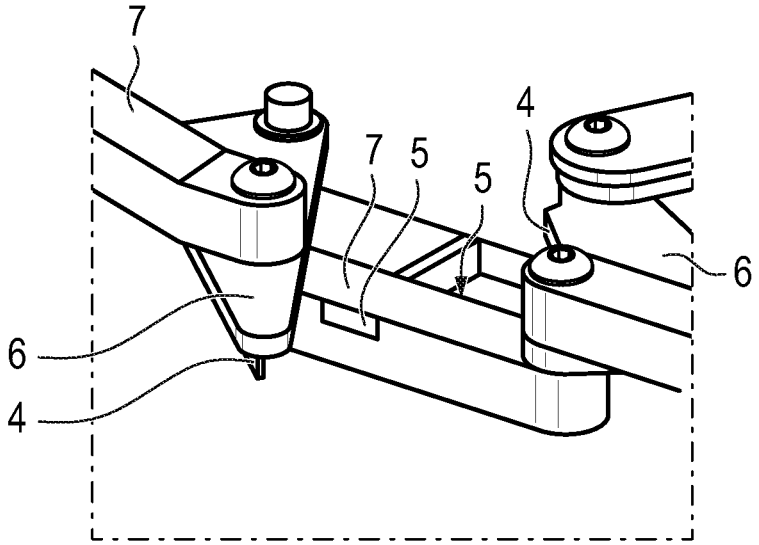
Figure 10:
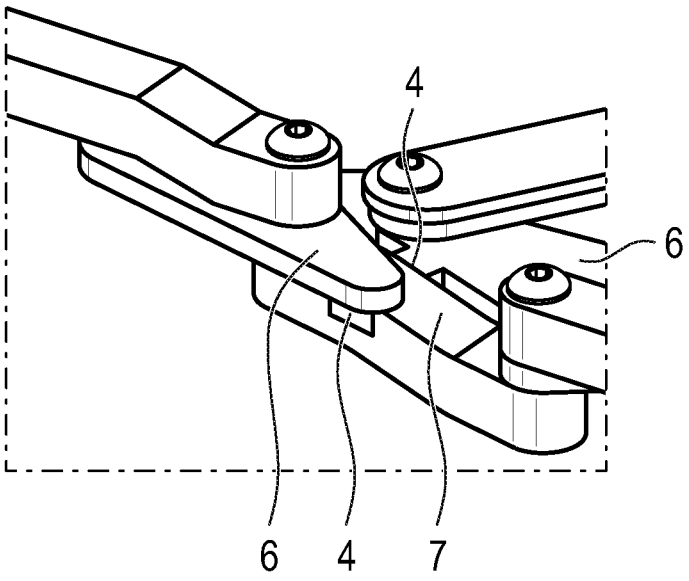
Figure 11:
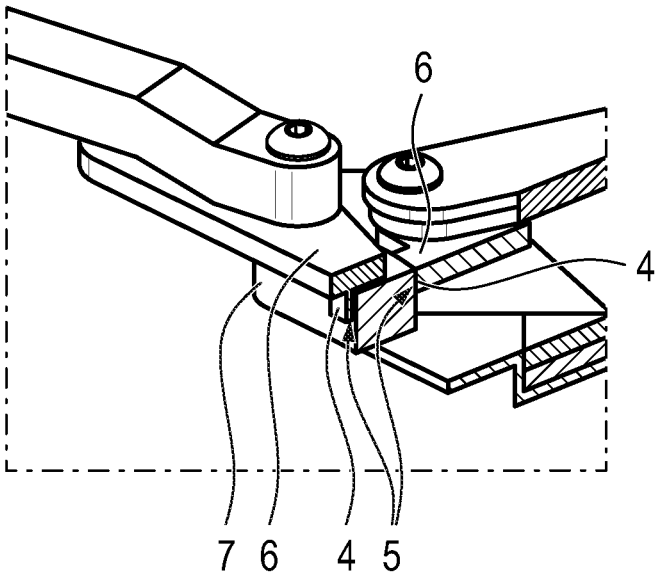

The invention is described in detail below using an exemplary embodiment with reference to the drawings. The drawings show:

FIG. 1 a schematic partial diagram of a first exemplary embodiment of a fin arrangement according to aspects of the invention in a closed position, FIG. 2 a schematic diagram of the first exemplary embodiment of the fin arrangement according to aspects of the invention in an open position, FIG. 3 a schematic partial diagram of a second exemplary embodiment of a fin arrangement according to aspects of the invention in an open position, FIG. 4 a schematic partial diagram of a second exemplary embodiment of a fin arrangement according to aspects of the invention in an open position according to FIG. 3, FIG. 5 a schematic diagram of a stop element in abutment against a counter stop according to FIGS. 3 and 4, FIG. 6 a schematic partial diagram of a third exemplary embodiment of a fin arrangement according to aspects of the invention in an open position, FIG. 7 a schematic partial diagram of a second exemplary embodiment of a fin arrangement according to aspects of the invention in an open position according to FIG. 6, FIG. 8 a schematic diagram of a stop element in abutment against a counter stop according to FIGS. 6 and 7, FIG. 9 a schematic partial diagram of a fourth exemplary embodiment of a fin arrangement according to aspects of the invention, FIG. 10 a further schematic partial diagram of the fourth exemplary embodiment of the fin arrangement according to FIG. 9, and FIG. 11 a further schematic partial diagram of the fourth exemplary embodiment of the fin arrangement according to aspects of the invention according to FIG. 10.

DETAILED DESCRIPTION OF THE INVENTION

The invention relates to a fin arrangement 1 of a cooling air opening comprising a number of fins 2, in particular of a bow of a motor vehicle.

FIGS. 1 and 2, show, by way of example, only two fins 2, wherein further fins may be arranged adjacently to the two fins 2 shown. The cooling air opening is also not shown in FIGS. 1 and 2.

The fins 2 are arranged in a rotatably mounted manner adjacently to the cooling air opening. For this purpose, the fins 2 are arranged by means of the bearings 3 in a rotatably mounted manner about an axis of rotation. FIG. 1 shows a closed position and FIG. 2 shows an open position. Accordingly, the fins 2 are arranged adjustably between a respective first end region of the adjustment, i.e., in the closed position, and a respective second end region of the adjustment, i.e., in the open position.

A drive (not shown) is provided, which is designed as an electromotive actuator, for example. For this purpose, the drive may comprise a housing in which an electric motor and an electronic control unit are provided, for example. A plug connector for the electrical connection and for controlling the drive is, for example, provided on the housing. On the output side, the drive, for example, comprises a shaft, which can be rotated in a driven manner.

A first fin 11 of the fins 2 is directly coupled to this drive for the purpose of directly driving the first fin 11. For indirectly driving the second fins 12, the first fin 11 is coupled to at least one second fin 12 of the fins 2 or to a plurality of second fins 12 of the fins 2. The coupling between the fins 2, 11, 12 is carried out by means of at least one coupling element 7. Accordingly, the first fin 2, 11 is coupled to at least one second fin 2, 12 of the fins 2 or to a plurality of second fins 2, 12 of the fins 2 for the purpose of indirectly driving the second fin 2, 12 or the second fins 2, 12, and/or one indirectly driven second fin 2, 12 is coupled to at least one further indirectly driven second fin 2, 12 by means of a coupling element 7 for the purpose of indirectly driving the further indirectly driven second fin 2, 12. Accordingly, either only one coupling element 7 may be provided or a number of such coupling elements 7 may be provided. In the exemplary embodiment of FIGS. 1 and 2, only one coupling element 7 is shown.

According to FIGS. 1 and 2, one stop element 4 each is connected to the fins 2 and abuts against a counter stop 5 on at least one end region of the adjustment of the fins 2. In this case, the stop elements 4 abut against the counter stops 5 in the open position.

According to FIGS. 1 and 2, a coupling rod is provided as a coupling element 7 for coupling all fins 2. Alternatively, one coupling rod each may be provided as a respective coupling element 7 for coupling two or more adjacent fins 2 in each case.

In FIGS. 1 and 2, it can also be seen that at least one fin 2 comprises or all fins 2 comprise a fin support 6, which is used to mount the fin 2 and to couple the fin 2 to the coupling element 3. The fin support 6 is hinged to the coupling element 7.

It can also be seen from FIGS. 1 and 2 that the stop element 4 is formed on the fin support 6 in at least one of the fins 2 or in all fins 2. Alternatively, it could also be advantageous if in at least one of the fins 2 or in all fins 2, the stop element 4 is formed on the fin 2 itself or on an additional element of the fin 2.

According to FIGS. 1 and 2, at least one counter stop 5 or the respective counter stop 5 is formed on the coupling element 7 or on the coupling elements 7.

In this case, it is expedient if, when providing a coupling rod as a coupling element 7 for a plurality of fins 2, the counter stops 5 are provided on the one coupling rod or that, when providing a plurality of coupling rods as coupling elements 7 for a plurality of fins 2, the counter stops 5 are provided on the coupling rods. Alternatively, it is also expedient if at least one counter stop 5 or the respective counter stop 5 is formed on an additional element or on a respective additional element, which is formed adjacently to the cooling air opening in a bow part of the motor vehicle.

FIGS. 1 and 2 show that the counter stops 5 are arranged as the coupling element 7 on one side of the coupling rod.

FIGS. 3 to 5 show a second exemplary embodiment of a fin arrangement 1 according to aspects of the invention. The fin arrangement 1 of FIGS. 3 to 5 comprises five fins 2. The cooling air opening is likewise not shown in FIGS. 3 to 5.

The fins 2 are arranged in a rotatably mounted manner adjacently to the cooling air opening. For this purpose, the fins 2 are arranged by means of the bearings 3 in a rotatably mounted manner about an axis of rotation. Accordingly, the fins 2 are arranged adjustably between a respective first end region of the adjustment, i.e., in the closed position, and a respective second end region of the adjustment, i.e., in the open position. FIGS. 3 and 4 show an open position.

A drive (not shown) is provided, which is designed as an electromotive actuator, for example. For this purpose, the drive may comprise a housing in which an electric motor and an electronic control unit are provided, for example. A plug connector for the electrical connection and for controlling the drive is, for example, provided on the housing. On the output side, the drive, for example, comprises a shaft, which can be rotated in a driven manner.

A first fin 11 of the fins 2 is directly coupled via a gear wheel 8 to this drive for the purpose of directly driving the first fin 11. For indirectly driving the second fins 12, the first fin 11 is coupled to at least one second fin 12 of the fins 2 or to a plurality of second fins 12 of the fins 2. The coupling between the fins 2, 11, 12 is carried out by means of at least one coupling element 7. Accordingly, the first fin 2, 11 is coupled to at least one second fin 2, 12 of the fins 2 or to a plurality of second fins 2, 12 of the fins 2 for the purpose of indirectly driving the second fin 2, 12 or the second fins 2, 12.

Alternatively or additionally, one indirectly driven second fin 2, 12 may also be coupled to at least one further indirectly driven second fin 2, 12 by means of a coupling element 7 for the purpose of indirectly driving the further indirectly driven second fin 2, 12. Accordingly, either only one coupling element 7 may be provided or a number of such coupling elements 7 may be provided. However, in the exemplary embodiment of FIGS. 3 to 5, only one coupling element 7 is shown.

According to FIGS. 3 to 5, one stop element 4 each is connected to the fins 2 and abuts against a counter stop 5 on at least one end region of the adjustment of the fins 2. In this case, the stop elements 4 abut against the counter stops 5 in the open position.

According to FIGS. 3 to 5, a coupling rod is provided as a coupling element 7 for coupling all fins 2. Alternatively, one coupling rod each may be provided as a respective coupling element 7 for coupling two or more adjacent fins 2 in each case.

In FIGS. 3 to 5, it can also be seen that at least one fin 2 comprises or all fins 2 comprise a fin support 6, which is used to mount the fin 2 and to couple the fin 2 to the coupling element 7. The fin support 6 is hinged to the coupling element 7.

It can also be seen from FIGS. 3 to 5 that the stop element 4 is formed on the fin support 6 in all fins 2. Alternatively, it could also be advantageous if in at least one of the fins 2 or in all fins 2, the stop element 4 is formed on the fin 2 itself or on an additional element of the fin 2.

According to FIGS. 3 to 5, at least one counter stop 5 or the respective counter stop 5 is formed on the coupling element 3 or on the coupling elements 3.

In this case, it is expedient if, when providing a coupling rod as a coupling element 7 for a plurality of fins 2, the counter stops 5 are provided on the one coupling rod or that, when providing a plurality of coupling rods as coupling elements 7 for a plurality of fins 2, the counter stops 5 are provided on the coupling rods. Alternatively, it is also expedient if at least one counter stop 5 or the respective counter stop 5 is formed on an additional element or on a respective additional element, which is formed adjacently to the cooling air opening in a bow part of the motor vehicle.

FIGS. 3 and 4 show that the counter stops 5 are arranged as the coupling element 7 on opposite sides of the coupling rod. One counter stop 5 is on an opposite side of the coupling rod, whereas four counter stops 5 are on the same side of the coupling rod. Accordingly, FIGS. 3 and 4 show that at least a first counter stop 5 and a second counter stop 5 are provided on at least one coupling rod, wherein the first counter stop 5 is arranged on an opposite side of the coupling rod with respect to the second counter stop 5.

The stop element 4 is a protruding element that projects from the fin support 6, see FIG. 5.

FIGS. 6 and 7 show a third exemplary embodiment of a fin arrangement 1 according to aspects of the invention. The fin arrangement 1 of FIGS. 6 to 8 comprises four fins 2. The cooling air opening is likewise not shown in FIGS. 6 to 8.

The fins 2 are arranged in a rotatably mounted manner adjacently to the cooling air opening. For this purpose, the fins 2 are arranged by means of the bearings 3 in a rotatably mounted manner about an axis of rotation. Accordingly, the fins 2 are arranged adjustably between a respective first end region of the adjustment, i.e., in the closed position, and a respective second end region of the adjustment, i.e., in the open position. FIGS. 6 and 7 show an open position.

A drive (not shown) is provided, which is designed as an electromotive actuator, for example. For this purpose, the drive may comprise a housing in which an electric motor and an electronic control unit are provided, for example. A plug connector for the electrical connection and for controlling the drive is, for example, provided on the housing. On the output side, the drive, for example, comprises a shaft, which can be rotated in a driven manner.

A first fin 11 of the fins 2 is directly coupled to this drive in a manner not shown for the purpose of directly driving the first fin 11. For indirectly driving the second fins 12, the first fin 11 is coupled to at least one second fin 12 of the fins 2 or to a plurality of second fins 12 of the fins 2. In the exemplary embodiment shown, the first fin 11 is coupled to two second fins 12. The coupling between the fins 2, 11, 12 is carried out by means of at least one coupling element 7. Accordingly, the first fin 2, 11 is coupled to at least one second fin 2, 12 of the fins 2 or to a plurality of second fins 2, 12 of the fins 2 for the purpose of indirectly driving the second fin 2, 12 or the second fins 2, 12. In the exemplary embodiment shown, a total of three coupling elements 7 are shown. One coupling element 7 each connects the first fin 11 to two second fins 12, and a second fin 12 is furthermore coupled to a further second fin 12 by means of the third coupling element 7.

Alternatively or additionally, one indirectly driven second fin 2, 12 may also be coupled to at least one further indirectly driven second fin 2, 12 by means of a coupling element 7 for the purpose of indirectly driving the further indirectly driven second fin 2, 12.

According to FIGS. 6 and 7, one stop element 4 each is connected to the fins 2 and abuts against a counter stop 5 on at least one end region of the adjustment of the fins 2. In this case, the stop elements 4 abut against the counter stops 5 in the open position.

According to FIGS. 6 and 7, coupling rods are provided as coupling elements 7 for coupling all fins 2 so that one coupling rod each is provided as a respective coupling element 7 for coupling two or more adjacent fins 2 in each case.

In FIGS. 6 to 8, it can also be seen that at least one fin 2 comprises or all fins 2 comprise a fin support 6, which is used to mount the fin 2 and to couple the fin 2 to the coupling element 7. The fin support 6 is hinged to the respective coupling element 7.

It can also be seen from FIGS. 6 to 8 that the stop element 4 is formed on the fin support 6 in all fins 2. Alternatively, it could also be advantageous if in at least one of the fins 2 or in all fins 2, the stop element 4 is formed on the fin 2 itself or on an additional element of the fin 2.

According to FIGS. 6 and 7, at least one counter stop 5 or the respective counter stop 5 is formed on the coupling element 7 or on the coupling elements 7.

When providing a plurality of coupling rods as coupling element 7 for a plurality of fins 2, it is expedient if the counter stops 5 are provided on the coupling rods. Alternatively, it is also expedient if at least one counter stop 5 or the respective counter stop 5 is formed on an additional element or on a respective additional element, which is formed adjacently to the cooling air opening in a bow part of the motor vehicle.

FIGS. 6 and 7 show that the counter stops 5 of one coupling rod are arranged as the coupling element 7 on opposite sides of the coupling rod. One counter stop 5 is on one side of the coupling rod, whereas a further counter stop 5 is on the other opposite side of the coupling rod.

The stop element 4 is a protruding element that projects from the fin support 6, see FIG. 8.

In a further exemplary embodiment, FIGS. 9 to 11 show how the counter stops 5 on one coupling rod as the coupling element 7 are on opposite sides so that the stop elements 4 of two fin supports 6 abut against the counter stops 5 of the one coupling rod.

LIST OF REFERENCE SIGNS

1 Fin arrangement
2 Fin
3 Bearing
4 Stop element
5 Counter stop
6 Fin support
7 Coupling element
8 Gear wheel
11 First fin
12 Second fin

What is claimed:

1. A fin arrangement for a cooling air opening, said fin arrangement comprising:

a plurality of fins, wherein the fins are adjustably arranged adjacently to the cooling air opening, wherein the fins are arranged adjustably between a respective first end region of the adjustment and a respective second end region of the adjustment, a drive directly coupled to a first fin of the plurality of fins for the directly driving the first fin, and wherein the first fin is coupled to a plurality of second fins of the plurality of fins by a plurality of coupling elements for driving the plurality of second fins, wherein each coupling element of the plurality of coupling elements is associated with one of the fins of the plurality of fins for moving the respective fin, wherein the plurality of coupling elements are indirectly connected together, and wherein each one of the fins includes a stop element and each one of the coupling elements includes a counter stop against which one of the stop elements abuts.

2. The fin arrangement according to claim 1, wherein at least one fin of the fins comprises a fin support, which fin support is used to mount said at least one fin and directly couple said at least one fin to one of the coupling elements.

3. The fin arrangement according to claim 2, wherein the stop element is formed on the fin support.

4. The fin arrangement according to claim 1, wherein the stop element is formed on one of the fins.

5. The fin arrangement according to claim 1, wherein each counter stop is disposed adjacently to the cooling air opening in a bow part of the motor vehicle.

6. A fin arrangement for a cooling air opening, said fin arrangement comprising:

a plurality of fins, wherein the fins are adjustably arranged adjacently to the cooling air opening, wherein the fins are arranged adjustably between a respective first end region of the adjustment and a respective second end region of the adjustment, a drive directly coupled to a first fin of the plurality of fins for the directly driving the first fin, and wherein the first fin is coupled to at least one second fin of the plurality of fins or to a plurality of second fins of the plurality of fins by at least one coupling element for indirectly driving either the second fin or the plurality of second fins, and/or one indirectly driven second fin is coupled to at least one further indirectly driven second fin by the at least one coupling element for the purpose of indirectly driving the further indirectly driven second fin, and one stop element each is connected to the fins and abuts against at least one counter stop on at least one end region of the adjustment of the fins, wherein the at least one counter stop or the respective counter stop is formed on the coupling element or on the coupling elements, wherein the at least one counter stop comprises a first counter stop and a second counter stop, wherein the first counter stop and the second counter stop are provided on at least one coupling rod, wherein the first counter stop is arranged on an opposite side of the coupling rod with respect to the second counter stop.

7. A motor vehicle having two cooling air openings and two of the fin arrangements according to claim 1.

8. A fin arrangement for a cooling air opening, said fin arrangement comprising:

a plurality of fins, wherein the fins are adjustably arranged adjacently to the cooling air opening, wherein the fins are arranged adjustably between a respective first end region of the adjustment and a respective second end region of the adjustment, a drive directly coupled to a first fin of the plurality of fins for the directly driving the first fin, and wherein the first fin is coupled to a plurality of second fins of the plurality of fins by a moveable coupling element for driving the plurality of second fins, and wherein at least one of the fins includes a stop element and the moveable coupling element includes a counter stop against which the stop element abuts.

9. The fin arrangement according to claim 1, wherein, for each fin, the stop element is a rectangular tab protruding from a surface of the fin.

10. The fin arrangement according to claim 1, wherein, for each fin, the stop element is disposed on a fin support that is disposed on a rear side of the fin.

11. The fin arrangement according to claim 10, wherein the fin support is rotatably mounted to one of the coupling elements.

* * * * *